US005356550A

United States Patent [19]

Cook et al.

[11] Patent Number: 5,356,550

[45] Date of Patent: Oct. 18, 1994

[54] LUBRICATING OIL ADDITIVES

[75] Inventors: Stephen J. Cook; Sean P. O'Connor, both of North Humberside, England

[73] Assignee: BP Chemicals (Additives) Limited, London, England

[21] Appl. No.: 488,058

[22] PCT Filed: Oct. 17, 1989

[86] PCT No.: PCT/GB89/01225

§ 371 Date: Jun. 8, 1990

§ 102(e) Date: Jun. 8, 1990

[87] PCT Pub. No.: WO90/04628

PCT Pub. Date: May 3, 1990

[30] Foreign Application Priority Data

Oct. 18, 1988 [GB] United Kingdom ..... 8824381

[51] Int. Cl.[5] ..... C10M 149/06; C10M 159/12

[52] U.S. Cl. ..... 252/51.5 A; 252/51.5 R; 252/43; 252/51; 525/375; 525/327.6

[58] Field of Search ..... 252/56 D, 51.5 R, 51, 252/51.5 A, 43; 525/375, 327.6

[56] References Cited

U.S. PATENT DOCUMENTS 3,365,399 1/1968 Verdol ..... 252/51.5 R

FOREIGN PATENT DOCUMENTS 1565627 4/1980 United Kingdom .

*Primary Examiner*—Prince Willis, Jr.
*Assistant Examiner*—Alan D. Diamond
*Attorney, Agent, or Firm*—Brooks Haidt Haffner & Delahunty

[57] ABSTRACT

A process for producing a dispersant/VI improver for use in finished lubricating oil compositions comprises reacting in a normally liquid substantially inert organic solvent (a) a copolymer of an olefin and a monomer having the structure (I), wherein X and $X^1$ are the same or different provided that at least one of X and $X^1$ is such that the copolymer can function as carboxylic acylating agent, (b) a succinimide, and (c) a primary or secondary amine or a mixture thereof. Preferred copolymers comprise maleic anhydride as a comonomer. In a preferred embodiment of the invention, the amine is a monoamine, and a polyamine is also added; the monoamine and polyamine are added to the reaction medium prior to addition of the succinimide.

11 Claims, No Drawings

LUBRICATING OIL ADDITIVES

The present invention relates generally to additives for use in lubricating oil compositions comprising and processes for producing said additives. In particular, the present invention relates to additives for use as dispersants and viscosity index improvers.

Operation of internal combustion engines is accompanied by the formation of piston varnish and sludge in the crankcase and in the oil passages of the engine. The sludge and varnish seriously restrict the ability of the crankcase oil to satisfactorily lubricate the engine. Furthermore, the sludge with its entrapped water tends to contribute to rust formation in the engine. To combat the varnish and sludge in internal combustion engines it has long been the practice to incorporate, into the lubricating oil, additives in the form of dispersants. The dispersants function to disperse the components of varnish and sludge throughout the oil and thereby prevent their accumulation.

It has long been known to use nitrogen-containing compounds as dispersants and/or detergents. Many of the known nitrogen-containing dispersants and/or detergent compounds are based on the reaction of an alkenylsuccinic acid or anhydride with an amine or polyamine to produce an alkenylsuccinimide or an alkenylsuccinamic acid depending upon the nature of the reactants and the reaction conditions.

More recently, the operating demands placed on internal combustion engines have led to a desirability for the dispersant additive to make a viscosity index improver contribution to the additive package sufficient to permit elimination of all or a significant amount of the viscosity index improver additive conventionally employed in such packages. In this connection GB-A-1565627 claims a lubricating composition comprising a major amount of oil of lubricating viscosity and a minor amount of one or more carboxylic derivatives produced by reacting at least one substituted succinic acylating agent with a reactant selected from (a) an amine having within its structure at least one H—N< group, (b) an alcohol, (c) a reactive metal or reactive metal compound, and (d) a combination of two or more of any of (a) to (c), the components of (d) being reacted with said one or more substituted succinic acylating agents simultaneously or sequentially in any order, wherein said substituted succinic acylating agent(s) consist of substituent groups and succinic groups wherein the substituent groups are derived from polyalkene, said polyalkene having a Mn value of 1300 to 5000 and a $M_w/M_n$ value of 1.5 to 4, said acylating agent(s) having within their structure an average of at least 1.3 succinic groups for each equivalent weight (as hereinbefore defined) of substituent groups.

Also claimed in GB-A-1565627 is a process for producing one or more of the aforementioned substituted acylating agents by heating at a temperature of at least 140° C.:

(A) Polyalkene having an $M_n$ value of 1300 to 5000 and a $Mw/M_n$ value of 1.5 to 4, (B) One or more acidic reactants of the formula

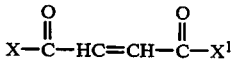

wherein X and $X^1$ are the same or different provided at least one of X and $X^1$ is such that the substituted acylating agent can function as a carboxylic acylating agent, or X and $X^1$ are joined and form an -O-link, (C) Chlorine.

We have now found that copolymers of an olefin and a monomer (B) as defined above can be used as acylating agents in the production of lubricating oil additives. A consequence of this is that chlorine is not used in the production of the acylating agent. Where chlorine is used in the preparative procedure to produce the substituted acylating agents and the carboxylic derivatives of GB-A-1565627, then these products can contain residual chlorine which can be detrimental in lubricating oil applications.

In addition, we have attempted to produce carboxylic derivatives from olefin/maleic anhydride copolymers as the acylating agent and succinimides, but it has been our experience that under certain circumstances the product therefrom is an oil-insoluble gel. However, we have found that when the reaction is effected in the presence of high carbon number amines an oil-soluble dispersant having an excellent viscosity index improver contribution is obtained.

Accordingly, the present invention provides a process for producing a dispersant/VI improver for use in finished lubricating oil compositions which process comprises reacting in a normally liquid substantially inert organic solvent (a) a copolymer of an olefin and a monomer having the structure:

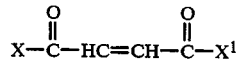

(I)

wherein X and $X^1$ are the same or different provided that at least one of X and $X^1$ is such that the copolymer can function as a carboxylic acylating agent, (b) a succinimide, and (c) a primary or secondary amine, or a mixture thereof.

A further aspect of the present invention provides a process for producing a dispersant/VI improver for use in finished lubricating oil compositions which process comprises reacting in a normally liquid substantially inert organic solvent (a) a copolymer of an olefin and a monomer having the structure:

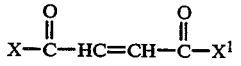

(I)

wherein X and $X^1$ are the same or different provided that at least one of X and $X^1$ is such that the copolymer can function as a carboxylic acylating agent, (b) a succinimide, and (c) a primary or secondary amine having at least 10 carbon atoms, or a mixture thereof.

By dispersant/VI improver we mean a product that acts primarily as a dispersant but which may also have viscosity index improving properties.

Reactant (a) is a copolymer of an olefin and a monomer having the structure (I). The olefin: monomer molar ratio in the copolymer is preferably 1:2 to 2:1, more preferably about 1:1.

As regards the olefin, this may be any polymerisable olefin characterized by the presence of one or more ethylenically unsaturated groups. The olefin may be either a terminal olefin or an internal olefin, preferably a terminal olefin. Although it is preferred to employ olefinic hydrocarbons, the olefin may contain non-hydrocarbon groups, for example alkoxy or hydroxy groups. Examples of suitable olefin monomers include 1-hexene, octadecene-1 diisobutylene. The olefin preferably is a $C_4$–$C_{30}$ olefin.

As regards the monomer having the structure (I), at least one, and preferably both X and $X^1$ must be such that the copolymer can esterify alcohols, form amides or amine salts with ammonia or amines, form metal salts with reactive metals or basically reacting metal compounds, and otherwise function as a conventional carboxylic acid acylating agent. Thus X and/or $X^1$ can be —OH, —O—hydrocarbyl, —$NH_2$, —Cl, Br, or together can be an oxygen atom so as to form the anhydride. Preferably X and/or $X^1$ are either —OH or together are an oxygen atom, more preferably X and $X^1$ are together an oxygen atom, i.e. the monomer having the structure (I) is maleic anhydride.

A range of suitable olefin/monomer having the structure (I) copolymers are commercially available. The molecular weight of said copolymer is preferably in the range 5,000–50,000. A preferred copolymer is a copolymer of polyoctadecene-1/maleic anhydride.

Reactant (b) is a succinimide. Preferably the succinimide is a hydrocarbyl substituted succinimide, wherein the hydrocarbyl substituent is derived from a polyalkene, for example a polyisobutene, suitably containing at least 30 carbon atoms. Such succinimides are well-known in the art and are commercially available. Succinimides derived by a chlorination or a non-chlorination route may be employed, but the use of succinimides derived from a chlorination route may give rise to a product containing residual chlorine. Both mono- and bis-succinimides may be used in the practice of the invention.

The succinimide head group (i.e. the group directly attached to the succinimide ring-nitrogen that does not form part of the succinimide ring) preferably contains at least one primary or secondary amine group or a hydroxyl group, preferably a primary amine group. Where the head group contains a primary amine group, the succinimide is a mono succinimide.

The succinimide will typically be derived from the reaction of a succinic anhydride with a polyamine which will contain at least two amine groups neither of which will be a tertiary amine. In this context typical polyamines will be tetraethylene pentamine, and triethylene tetramine. In addition, alcoholamines or polyoxyalkylene polyamines can be used, for example materials supplied under the trade name Jeffamine.

The succinimide is suitably prepared from PIBSA with an average molecular weight of 500–3,000 preferably 1500–2000.

Reactant (c) is a primary or secondary amine or a mixture thereof. The primary and secondary amines mentioned above preferably have at least 10 carbon atoms, more preferably between 12 and 18 carbon atoms. Although aromatic amines may be employed, it is preferred to use aliphatic amines. Both saturated and unsaturated amines may be employed. Preferred amines include aliphatic primary amines, which may be either monoamines or polyamines. Examples of suitable amines include octadecylamine and dodecylamine. An example of a suitable mixture of amines is tallowamine (a partially saturated mixture of amines comprised mainly of $C_{18}$ amines). Polyoxyalkylene polyamines (for example materials supplied under the trade name Jeffamine) can also suitably be used.

Reactants (a) to (c) are reacted in the presence of a normally liquid substantially inert organic solvent. Preferably the solvent is a high-boiling hydrocarbon solvent. Such solvents include higher carbon number paraffins and liquid polyolefins. In view of the intended use of the product it is preferred to use as the solvent an oil of lubricating viscosity. Both natural and synthetic lubricating oils may be used.

Reaction is preferably effected at elevated temperature, suitably in the range from 75° to 300° C., preferably from 150° to 250° C.

The ratio of reactants (a) to (c) to solvent is suitably such that the product of the reaction of reactants (a) to (c) forms a concentrate composition, in the solvent. The composition suitably comprising from 10 to 80% by weight of the product.

In a preferred embodiment of the present invention, the amine (c) is a monoamine having a primary or secondary amine group; a polyamine having at least two amine groups neither of which is a tertiary amine group is also reacted with said copolymer (a); subsequent to the reaction of the above mentioned monoamine and polyamine with the copolymer (a), succinimide (b) is added to the reaction medium. In this context, it is important that the total number of amine groups in amine (c) and the polyamine does not exceed the number of units of monomer (I) incorporated into the copolymer (a) and available for reaction with said amine groups. The monoamine and polyamine can be added sequentially or as a mixture.

An example of a suitable monoamine is octadecylamine, examples of a suitable polyamine is diaminododecane.

In said preferred embodiment the succinimide will preferably be added in large excess, preferably in an amount greater than 5 times by weight the amount of copolymer, monoamine and polyamine together, more preferably in the range 10–25 times said amount.

In another aspect the present invention provides a finished lubricating oil composition comprising a major proportion of an oil of lubricating viscosity and a minor proportion of the product as hereinbefore described.

Suitably the finished lubricating oil composition may be obtained by diluting the concentrate composition as hereinbefore described with oil of lubricating viscosity. Suitably the oil of lubricating viscosity may be any natural or synthetic lubricating oil. Suitable lubricating oils are described for example in the aforesaid GB-A-156527.

The finished lubricating oil composition may contain conventional additives, for example one or more of anti-wear additives, antioxidants, anti-rust additives and viscosity index improvers. It is an advantage of the present invention, however, that at least some of the VI improver additive conventionally present in lubricating oil compositions may be omitted. The conventional additives mentioned above may be added either directly to the lubricating oil composition or to the concentrate composition.

The invention will now be further illustrated by reference to the following examples.

Examples 1–21 were carried out according to Procedure (A) set out below; Examples 22–27 were carried out according to Procedure (B) set out below.

PROCEDURE (A)

1. Mix Copolyolefin-MA (POMA), amine and succinimide in SN150 oil at room temperature.
2. Heat to 170°–180° C. for 0.5–3 hr.
3. Strip for 0.5–1 hr.
4. Blend to 5.5% w/w active components and measure viscometrics.

Details of each of Examples 1–21 are given in Table I and the viscosity results on the products are given in Table II.

"Crude actives" the amount of product from reaction of POMA, amine and succinimide expressed as a weight percent in the final reaction mixture.

"Active components" refers to the amount of the above product in the final blended product.

TABLE II

| | Conc. | V100 Cst | Viscosity Results V40 Cst | V-20 P | VI | Petter AVB Engine test |
|---|---|---|---|---|---|---|
| 1 | 5.5 | 8.08 | 49.5 | 39 | 135 | |
| 2 | 5.5 | 16.1 | 79.5 | 35.5 | 218 | |
| 3 | 5.5 | 7.99 | 52.5 | 37 | 121 | |
| 4 | 5.5 | 7.58 | 46.27 | 39 | 130 | |
| 5 | 5.5 | 6.95 | 42.10 | 36 | 124 | |
| 6 | 5.5 | 8.32 | 52.0 | 36 | 133 | |
| 7 | 5.5 | 9.71 | 60.4 | 38 | 145 | |
| 8 | 5.5 | 9.40 | 57.7 | 39 | 145 | |
| 9 | 5.5 | 10.72 | 66.45 | 37.5 | 151 | |
| 10 | 5.5 | 7.93 | 48.9 | 32.0 | 132 | |
| 11 | 5.5 | 9.13 | 57.2 | 37.5 | 140 | |
| 12 | 5.5 | 7.72 | 48.9 | 39.0 | 125 | |
| 13 | 5.5 | 8.12 | 51.1 | 32.0 | 130 | |
| 14 | 5.5 | 9.08 | 58.2 | 34 | 135 | |
| 15 | 5.5 | 8.12 | 52.7 | 37 | 124 | 66/100 |
| 16 | 5.5 | 8.20 | 50.9 | 35 | 133 | [Pass = 60 ] |
| 17 | 5.5 | 12.2 | 73.7 | 36.5 | 163 | |
| 18 | 5.5 | 12.0 | 72.4 | 34.0 | 163 | |
| 19 | 5.5 | 9.4 | 57.7 | 39.0 | 145 | |
| 20 | 5.5 | 16.1 | 79.5 | 35.5 | 218 | |

TABLE I

Examples by Procedure (A)

| | POMA/g (molar equivs) | amine/g (molar equivs) | succinimide/g (molar equivs) | Oil | Reaction Temp | [reacn + strip] Reaction Time/hr | Crude Actives conc. | POMA MWt (by GPC) |
|---|---|---|---|---|---|---|---|---|
| 1 | PolyPentene-1/MA 5.5 g (1.0) | Dodecylamine 4.3 g (0.7) | ADX201 15.7 g (0.3) | 60 g | 180° | 2 + 1 | 25% | 8900 |
| 2 | Poly Hexene-1/MA 6.0 g (1.0) | Dodecylamine 4.3 g (0.7) | ADX201 15.7 g (0.3) | 61 g | 170° | 2 + ¾ | 25% | 21000 |
| 3 | Poly (4methylpentene-1)/MA 6.0 g (1.0) | Dodecylamine 4.3 g (0.7) | ADX201 15.7 g (0.3) | 61 g | 180° | 2½ + ½ | 25% | 8500 |
| 4 | Poly Octene-1/MA 6.9 g (1.0) | Dodecylamine 4.3 g (0.7) | ADX201 15.7 g (0.3) | 65 g | 180° | 2 + 1 | 25% | 12200 |
| 5 | Poly Decene-1/MA 7.9 g (1.0) | Dodecylamine 4.3 g (0.7) | ADX201 15.7 g (0.3) | 67 g | 180° | 2 + 1 | 25% | 14400 |
| 6 | Poly Octadecene-1/MA 10.9 g (1.0) | Dodecylamine 4.1 g (0.7) | ADX201 14.9 g (0.3) | 70 g | 180° | 2 + 1 | 25% | 26000 |
| 7 | Polyhexene-1/MA 6.1 g (1.0) | hydrogenated tallowamine 6.5 g (0.7) | ADX201 15.8 g (0.3) | 68 g | 170° | 2 + ½ | 25% | 21000 |
| 8 | Polyhexene-1/MA 5.5 g (1.0) | Octadecylamine 6.5 g (0.8) | ADX201 16.6 g (0.2) | 68 g | 170° | 1 + ¼ | 25% | 21000 |
| 9 | Polyhexene-1/MA 5.0 g (1.0) | Dodecylamine 2.65 g (0.5) | ADX201 22.4 g (0.5) | 66 g | 170° | 2½ + ⅓ | 25% | 21000 |
| 10 | Polyoctadecene-1/MA 10.0 g (1.0) | Octadecylamine 3.9 g (0.5) | ADX201 40.1 g (1.0) | 34 g | 190° | 2 + 1 | 49% | 26000 |
| 11 | Poly Octadecene-1/MA 10.1 g (1.0) | Octadecylamine 3.8 g (0.5) | H10-200 40.0 g (0.5) | 34 g | 190° | 3 + 1 | 49% | 26000 |
| 12 | Poly Octadecene-1/MA 7.0 g (1.0) | Octadecylamine 3.8 g (0.7) | H10-200 40.1 g (0.7) | 31 g | 190° | 3 + 1 | 49% | 26000 |
| 13 | Poly Octadecene-1/MA 8.6 g (1.0) | Dodecylamine 2.7 g (0.6) | H10-200 40 g (0.65) | 34 g | 190° | 3½ + ½ | 47% | 26000 |
| 14 | Poly Octadecene-1/MA 8.6 g (1.0) | Dimethylamino propylamine 3.8 g (0.5) | H10-200 40 g (0.65) | 29 g | 190° | 3 + 1 | 55% | 26000 |
| 15 | Poly Octadecene-1/MA 66 g (1.0) | Dimethylamino propylamine 13.6 g (0.65) | H10-200 539 g (1.1) | 242 g | 190° | 3 + 1 | 55% | 26000 |
| 16 | Poly Octadecene-1/MA 8.5 g (1.0) | Dodecylamine 13.6 g (0.65) | H10-200 539 g (1.1) | 34 g | 190° | 3½ + ½ | 48% | 26000 |
| 17 | Polyhexene-1/MA (1.0) | Tallowamine (0.78) | Succ.-1 (0.29) | | 170° | ½ + ½ | 25% | |
| 18 | Polyhexene-1/MA (1.0) | Dodecylamine (0.78) | Succ.-1 (0.29) | | 170° | ½ + ½ | 25% | |
| 19 | Polyhexene-1/MA (1.0) | Octadecylamine (0.78) | Succ.-1 (0.29) | | 170° | ½ + ½ | 25% | |
| 20 | Polyhexene-1/MA (1.0) | Dodecylamine (0.71) | Succ.-1 (0.29) | | 170° | 2 + 0.75 | 25% | |
| 21 | Polyhexene-1/MA (1.0) | Dodecylamine (0.59) | Succ.-1 (0.41) | | 170° | 2 + 0.5 | 25% | |

ADX201 = Hyvis 10 based PIB mono-succinimide with tetraethylene pentamine
H10-200 = Hyvis 10/Hyvis 200 based PIB mono-succinimide with tetraethylene pentamine
SUCC-1 = Polyisobutene [MWt = 1000] substd. succinic anhydride and tetraethylene tetramine TABLE II-continued

| | Conc. | Viscosity Results V100 Cst | V40 Cst | V-20 P | VI | Petter AVB Engine test |
|---|---|---|---|---|---|---|
| 21 | 5.5 | 17.2 | 85.6 | 35.5 | 220 | |

PROCEDURE (B)

1. Mix Co polyolefin-MA (POMA), and amine in oil at room temperature.
2. Heat to 185° for ¼ hour.
3. Add a hot solution (10% concentration) of polyamine in oil (100°) over a few minutes and stir at 185° for ½ hour.
4. Strip at 185° for ¼ hour.
5. Collect this intermediate product.
6. Heat succinimide to 185°.
7. Add intermediate and stir for 2½ hours at 185°.
8. Strip at 185° for ½ hour.
9. Blend a sample for viscometrics.

Details of each of Examples 22–27 are given in Table III and the viscosity results on the products are given in Table IV. For comparison purposes, the viscometrics for ADX201 and ADX212 were measured and are given in Table IV also.

TABLE III

| | POMA/g (molar equivs) | amine/g (molar equivs) | Examples by Procedure (B) Polyamine/g (molar equivs) | Oil (SN150) | Succinimide/g | Crude Actives % |
|---|---|---|---|---|---|---|
| 17 | PODMA 7.1 g (1.0) | Dodecylamine 0.8 g (0.2) | Tetraethylene-pentamine,1.1 g (0.2) | 60 g | H10-200 60 g | 41 |
| 18 | PODMA 7.1 g (1.0) | Octadecylamine 1.1 g (0.2) | Tetraethylene-pentamine,1.1 g (0.2) | 60 g | H10-200 60 g | 41 |
| 19 | PODMA 6.0 g (1.0) | Octadecylamine 0.9, (0.2) | Diaminododecane 0.7 g (0.4) | 50 g | H10-200 50 g ADX212 50 g | 51 |
| 20 | PODMA 6.0 g (1.0) | Octadecylamine 0.9 g (0.2) | Diaminododecane 1.0 g (0.6) | 50 g | H10-200 50 g ADX212 50 g | 51 |
| 21 | PODMA 36 g (1.0) | Octadecylamine 11.1 g (0.4) | Diaminododecane 3.6 g (0.35) | 238 g | ADX212 599 g | 55 |
| 22 | PODMA 756 g (1.0) | Octadecylamine 233 g (0.4) | Diaminododecane 75.6 g (0.35) | 1200 g | ADX212 18940 g | 61 |

ADX201 = Hyvis 10 based PIB mono-succinimide with tetraethylene pentamine
H10-200 = Hyvis 10/Hyvis 200 based PIB mono-succinimide with tetraethylene pentamine
SUCC-1 = Polyisobutene [MWt = 1000] substd. succinic anhydride and tetraethylene tetramine

TABLE IV

| | Conc. | Viscosity Results Viscosity V100/Cst | V40/Cst | V-20/P | VI | Petter AVB Engine test |
|---|---|---|---|---|---|---|
| 17 | 5.5% | 8.49 | 53.6 | 32 | 133 | |
| 18 | 5.5% | 8.13 | 49.6 | 33 | 136 | |
| 19 | 5.5% | 7.66 | 48.6 | 35.5 | 124 | |
| 20 | 5.5% | 7.68 | 48.5 | 37.0 | 124 | |
| 21 | 5.5% | 7.72 | 49.9 | 35.5 | 121 | 72/100 |
| 22 | 6.1% | 7.82 | 50.0 | 36 | 124 | 77/100 PASS = 60 |
| Compare: | | | | | | |
| ADX201 | 5.5% | 7.38 | 50.7 | 47.0 | 106 | |
| ADX212 | 6.0% | 7.41 | 48.6 | 38.0 | 115 | |

We claim:

1. A process for producting a dispersant/VI improver for use in finished lubricating oil compositions which process comprises reacting in a normally liquid inert organic solvent (a) a copolymer of an olefin and a monomer having the structure:

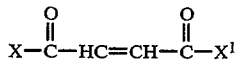

(I)

wherein X and $X^1$ are the same or different and are selected from the group consisting of —OH, —O—hydrocarbyl, —$NH_2$, —Cl, —Br, and together is an oxygen atom provided that at least one of X and $X^1$ is such that the copolymer can function as a carboxylic acylating agent, (b) a hydrocarbyl substituted succinimide derived from a polyalkene containing at least 30 carbon atoms, and (c) a primary or secondary amine or mixture thereof.

2. A process as claimed in claim 1 wherein (c) is a primary or secondary amine having at least 10 carbon atoms or a mixture thereof.

3. A process as claimed in either claim 1 or claim 2 wherein the monomer is maleic anhydride.

4. A process as claimed in claim 1 wherein (c) is a primary or secondary amine having between 12 and 18 carbon atoms or a mixture thereof.

5. A process as claimed in claim 4 wherein the primary amine is either dodecylamine or octadecylamine.

6. A process as claimed in claim 1 wherein the succinimide comprises a head group comprising at least one moiety selected from the group consisting of primary amine group, secondary amine group and hydroxyl group.

7. A process as claimed claim 1 wherein (c) is a monoamine and the process further comprises adding a polyamine having at least two amine groups which are not tertiary amine groups, said monoamine and said polyamine being added to said copolymer prior to addition of said succinimide.

8. A process as claimed in claim 7 wherein said polyamine is a $C_6$–$C_{12}$ diamine.

9. A product obtained by the process as claimed in claim 1.

10. A lubricating oil composition comprising a major proportion of an oil of lubricating viscosity and a minor amount of the product as claimed in claim 9.

11. A process as defined in claim 1 wherein the reaction is effected at a temperature of from 75° to 300° C.

* * * * *

UNITED STATES PATENT AND TRADEMARK OFFICE

CERTIFICATE OF CORRECTION

PATENT NO. : 5,356,550

DATED : October 18, 1994

INVENTOR(S) : STEPHEN J. COOK and SEAN P. O'CONNOR

It is certified that error appears in the above-indentified patent and that said Letters Patent is hereby corrected as shown below:

Col. 5, Table 1, Example 14, 2nd col. "amine", change "3.8g (0.5)" to --1.5g (0.6)--

Col. 5, Table 1, Example 16, 2nd and 3rd cols. headed "amine" and "succinimide", respectively, change "13.6g (0.65)" to --3.9g (0.85)-- and change "539g (1.1)" to --40g (0.65)--

Col. 7, Table III, in the footnote legends, cancel the lines starting with "ADX 201" and "SUCC-1" and replace these lines with the following:

--ADX 212 = Hyvis 10 - Hyvis 200 based PIB succinimide with tetraethylenepentamine PODMA = Polyoctadecene -1-maleicanhydride ($MW_r$ by GPC 26000) from Gulf Chevron.--

Claim 7, first line, after "claimed" and before "claim" insert --in--

Signed and Sealed this

Seventh Day of February, 1995

Bruce Lehman

*Attest:*

BRUCE LEHMAN

*Attesting Officer*

*Commissioner of Patents and Trademarks*